US007874232B2

(12) United States Patent
Gauthreaux et al.

(10) Patent No.: US 7,874,232 B2
(45) Date of Patent: Jan. 25, 2011

(54) QUICK-CHANGE SOCKET AND HEX KEY RETAINER ASSEMBLY FOR A FASTENER INSTALLATION TOOL

(75) Inventors: Donald Paul Gauthreaux, Fullerton, CA (US); Charles Henry Dibley, Mission Viejo, CA (US); Richard Craig Lantow, Yorba Linda, CA (US); Jay Raymond Olkowski, Montclair, CA (US)

(73) Assignee: Huck Patents, Inc., Wilmington, DE (US)

( * ) Notice: Subject to any disclaimer, the term of this patent is extended or adjusted under 35 U.S.C. 154(b) by 40 days.

(21) Appl. No.: 12/253,018

(22) Filed: Oct. 16, 2008

(65) Prior Publication Data

US 2010/0095811 A1 Apr. 22, 2010

(51) Int. Cl.
*B25B 13/06* (2006.01)
*B25B 17/00* (2006.01)

(52) U.S. Cl. ..... 81/58; 81/57; 81/57.44

(58) Field of Classification Search ..... 81/56, 81/58, 55, 57, 57.44, 121.1, 60
See application file for complete search history.

(56) References Cited

U.S. PATENT DOCUMENTS 4,617,844 A * 10/1986 Batten ..... 81/56
5,305,666 A * 4/1994 LaTorre ..... 81/55
5,553,519 A 9/1996 Pettit, Jr.
5,778,741 A * 7/1998 Batten ..... 81/56
6,752,046 B1 6/2004 Lee
6,935,209 B2 8/2005 Lantow et al.
6,948,406 B1 * 9/2005 Li ..... 81/60
7,287,447 B2 * 10/2007 Pettit, Jr. ..... 81/56
2005/0044993 A1 3/2005 Lantow et al.
2007/0107557 A1 5/2007 Pettit

FOREIGN PATENT DOCUMENTS

DE 202 08 490 U 6/2002

OTHER PUBLICATIONS

International Search Report dated Feb. 18, 2010 issued in connection with Applicant's International Patent Application No. PCT/US2009/059929 (4 pages).
Written Opinion dated Feb. 18, 2010 issued in connected with Applicant's International Patent Application No. PCT/US2009/059929 (7 pages).

* cited by examiner

*Primary Examiner*—Hadi Shakeri
(74) *Attorney, Agent, or Firm*—Greenberg Traurig, LLP

(57) ABSTRACT

A system, apparatus, and method for installing fasteners are disclosed involving a fastener installation tool and a socket assembly. The fastener installation tool comprises a tool component and a gear head. The gear head comprises a lever, a retaining slide, a retaining slide housing, and at least one gear. The socket assembly comprises a socket, a hex key, and a hex key retainer. An end of the drive shaft of the socket has an annular groove around the circumference of the exterior surface of the drive shaft. When the retaining slide is slid into a locked position, the retaining slide engages the annular groove of the drive shaft of the socket, thereby attaching the drive shaft of the socket to the gear head of the fastener installation tool. A socket gear of the gear head matingly engages the drive shaft of the socket to rotate the socket.

17 Claims, 7 Drawing Sheets

QUICK-CHANGE SOCKET AND HEX KEY RETAINER ASSEMBLY FOR A FASTENER INSTALLATION TOOL

BACKGROUND OF THE DISCLOSURE

The present disclosure relates to a quick-change socket and hex key retainer assembly for a fastener installation tool. In particular, it relates to a quick-change socket and hex key retainer assembly for a fastener installation tool for installing fasteners.

SUMMARY OF THE DISCLOSURE

The present disclosure relates to an apparatus, system, and method for a quick-change socket and hex key retainer assembly for a fastener installation tool for installing fasteners. In one or more embodiments, the system for the quick-change socket and hex key retainer assembly for a fastener installation tool includes a fastener installation tool and a socket assembly. The fastener installation tool comprises a tool component and a gear head. The gear head is attached to an end of the tool component.

In one or more embodiments, the gear head comprises a lever, a retaining slide, a retaining slide housing, and at least one gear. The at least one gear comprises a socket gear. The lever is attached to the retaining slide. The retaining slide is housed inside the retaining slide housing and the lever protrudes out from an exterior surface of the retaining slide housing.

In one or more embodiments, the socket assembly comprises a socket. An end of a drive shaft of the socket has an annular groove around a circumference of an exterior surface of the drive shaft. When the retaining slide is in a locked position, the retaining slide engages the annular groove of the drive shaft of the socket, thereby attaching the drive shaft of the socket to the gear head of the fastener installation tool. The socket gear matingly engages the drive shaft of the socket to rotate the socket.

In one or more embodiments, the lever is a ball plunger screw. The fastener tool is powered by pneumatic energy. In some embodiments, the fastener tool is powered by DC/AC electricity. In one or more embodiments, the fastener tool is powered by at least one battery. In some embodiments, the fastener tool is powered by hydraulic energy.

In one or more embodiments, the socket gear has a non-circular interior surface. The drive shaft of the socket has a non-circular exterior surface that is complementary in shape to the non-circular interior surface of the socket gear. The non-circular exterior surface of the drive shaft of the socket matingly engages inside the non-circular interior surface of the socket gear. In some embodiments, the non-circular interior surface of the socket gear includes a flat surface. The non-circular exterior surface of the drive shaft of the socket includes a flat surface.

In one or more embodiments, the system for installing fasteners comprises a fastener installation tool and a socket assembly. The fastener installation tool comprises a tool component and a gear head. The gear head is attached to an end of the tool component. The gear head comprises a lever, a retaining slide, and a retaining slide housing. The lever is attached to the retaining slide. The retaining slide is housed inside the retaining slide housing, and the lever protrudes out from an exterior surface of the retaining slide housing.

In one or more embodiments, the socket assembly comprises a socket, a hex key, and a hex key retainer, where the socket assembly is a single fixed structure. An end of a drive shaft of the socket has an annular groove around a circumference of an exterior surface of the drive shaft. When the retaining slide is in an unlocked position, the retaining slide disengages the annular groove of the drive shaft of the socket, thereby releasing the socket assembly single fixed structure.

BRIEF DESCRIPTION OF THE DRAWINGS

These and other features, aspects, and advantages of the present disclosure will become better understood with regard to the following description, appended claims, and accompanying drawings where:

DETAILED DESCRIPTION

The apparatus and methods disclosed herein provide an operative system for installing fasteners. Specifically, this fastener installation system employs a quick-change socket and hex key retainer assembly for a fastener installation tool. In particular, this system allows for installing a threaded nut onto a threaded screw fastener of the type having a non-circular recess in an end of the screw fastener that matingly engages to the non-circular recess with a male member that has a complementary shaped non-circular tip end.

Threaded fasteners are often utilized in applications in where it is difficult to work from both sides of the structures that are to be secured together. In such applications, it has been the practice to use a fastener installation tool having a hex key, or any other non-circular bit, which is inserted into a broached recess of a screw type fastener to hold the fastener stationary while a non-circular threaded nut is threaded onto the screw fastener by the use of a socket that is attached to the fastener installation tool. When the nut is threaded onto the screw fastener with the fastener installation tool and the screw fastener is restrained against rotation by the hex key to secure the structures together in a fastened joint, the fastener is secured. In many fastener installation systems such as these, it is very difficult and time consuming to remove and replace the socket of the fastener installation tool with another socket of a different size. As such, an object of the present disclosure is to provide a fastener installation system such that a socket of one size, which is attached to the fastener installation tool, can be easily and quickly removed and replaced with a socket of a different size without using any accessory hand tools or retaining clip pliers.

In the following description, numerous details are set forth in order to provide a more thorough description of the system. It will be apparent, however, to one skilled in the art, that the disclosed system may be practiced without these specific details. In the other instances, well known features have not been described in detail so as not to unnecessarily obscure the system.

Figure 1:
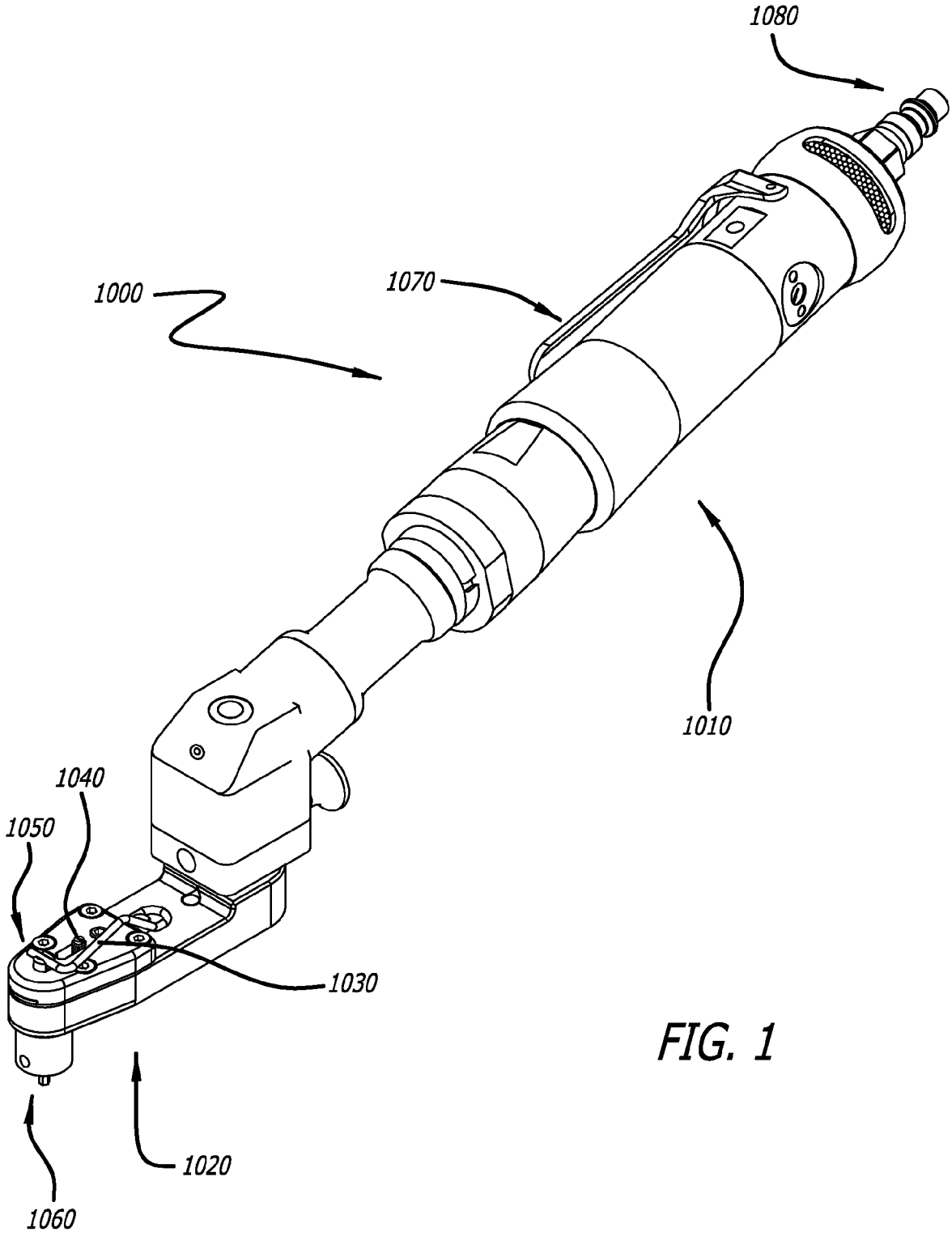
FIG. 1 is an isometric view of the fastener installation tool engaged with the socket assembly in accordance with at least one embodiment of the present disclosure.

FIG. 1 contains an isometric view of a fastener installation tool 1000 engaged with a socket assembly 1060 in accordance with at least one embodiment of the present disclosure. In this figure, a fastener installation tool 1000 is shown as having a tool component 1010 secured to a gear head 1020. The tool component 1010 of the fastener installation tool 1000 is adapted for mount-on quick-connect coupling to the drive end of the tool component 1010, such as a rotary drive tool of the type known in the art. The gear head 1020 of the fastener installation tool 1000 includes a spring 1030, a lever 1040, and a retaining slide 1050, which will all be described below in greater detail. In addition, a socket assembly 1060 is shown as being mounted to the spring 1030 that is located towards the extreme end of the gear head 1020 of the fastener installation tool 1000. The fastener installation tool 1000 is used for installing a threaded fastener through aligned openings located in the structures.

Also in this figure, the tool component 1010 of the fastener installation tool 1000 is illustrated as having a power lever 1070 and a pneumatic port 1080. During operation of the fastener installation tool 1000, the pneumatic port 1080 is connected to at least one pneumatic hose (not shown), which is in turn connected to at least one pneumatic pressure source (not shown). In alternative embodiments, the fastener installation tool 1000 of the present disclosure may be powered by various other types of energy including, but not limited to, hydraulic energy, direct current (DC) electricity, alternating current (AC) electricity, battery, and manual energy. In order for the fastener installation tool 1000 to be powered on, the power lever 1070 must be depressed. In other embodiments, various other types of switches, buttons, and levers may be employed instead of a power lever 1070 as is depicted in FIG. 1.

Figure 2:
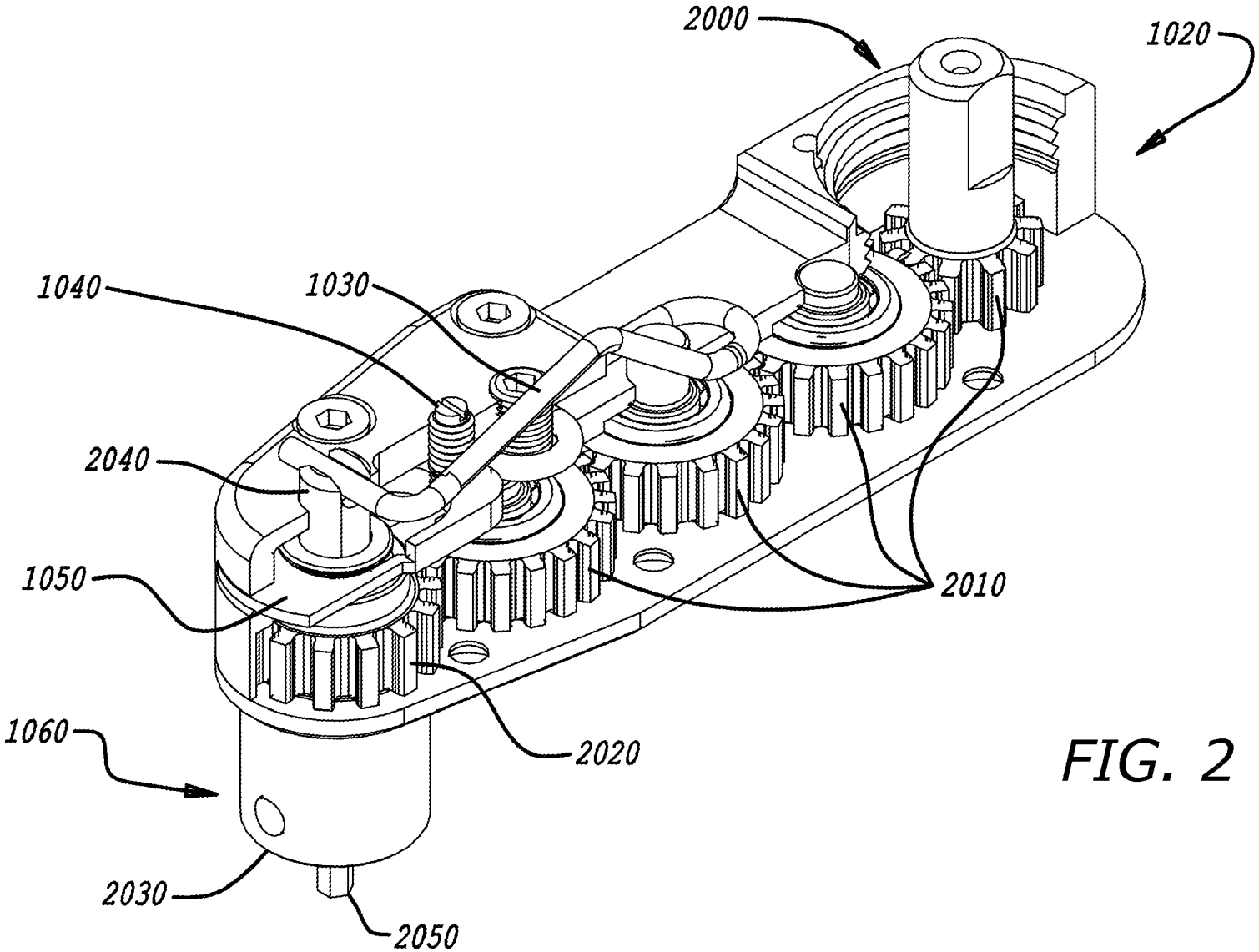
FIG. 2 is a partial cross-sectional view of the gear housing of the gear head of the fastener installation tool with the retaining slide in the locked position in accordance with at least one embodiment of the present disclosure.

FIG. 2 is a partial cross-sectional view of the gear head 1020 of the gear housing 2000 of the gear head 1020 of the fastener installation tool 1000 with the retaining slide 1050 in the locked position in accordance with at least one embodiment of the present disclosure. As shown in this figure, a socket assembly 1060 is engaged with the gear head 1020 of the fastener installation tool 1000. In order for the socket assembly 1060 to be engaged with the gear head 1020, the first step involves the drive shaft of the socket 2030 of the socket assembly 1060 being inserted into a recess of the socket gear 2020 in the gear head 1020; and a hex key retainer sub-assembly 2040, which is part of the socket assembly 1060, being mounted and/or engaged with the spring 1030 of the gear head 1020.

The drive shaft of the socket 2030 of the socket assembly 1060 has a non-circular exterior surface. The interior surface of the socket gear 2020 is a non-circular surface that is complementary in shape to the non-circular exterior surface of the drive shaft of the socket 2030 of the socket assembly 1060. Since these two surfaces are complementary in shape, the non-circular exterior surface of the drive shaft of the socket 2030 can matingly engage inside the non-circular interior surface of the socket gear 2020. In at least one embodiment, the non-circular interior surface of the socket gear 2020 of the fastener installation tool 1000 includes a flat surface, and the non-circular exterior surface of the drive shaft of the socket 2030 includes a flat surface. In alternative embodiments, the non-circular surfaces may include various types of surfaces, which may include no flat surfaces or more than one flat surface.

The hex key retainer sub-assembly 2040 has a yoke configuration such that the spring 1030 rests inside the yoke. In alternative embodiments, the engagement and/or mounting of the hex key retainer sub-assembly 2040 with the spring 1030 may be achieved in various other ways. In addition, in one or more embodiments, hex key retainer sub-assembly 2040 may be formed to be various other shapes than as shown in FIG. 2.

After the drive shaft of the socket 2030 of the socket assembly 1060 is inserted into a recess of a socket gear 2020 and the hex key retainer sub-assembly 2040 of the socket assembly 1060 is engaged and/or mounted with the spring 1030 of the gear head 1020, the second step involves the lever 1040 being slid towards the tool component 1010 end of the fastener installation tool 1000. When the lever 1040 is slid towards the tool component 1010, the lever 1040 moves the retaining slide 1050 into the locked position. When the retaining slide 1050 is being moved into the locked position, the retaining slide slides into and engages an annular groove that is located around the circumference of the exterior surface of the drive shaft of the socket 2030 of the socket assembly 1060. Once the retaining slide 1050 is engaged with the annular groove, the socket assembly 1060 is secured and engaged to the gear head 1020 of the fastener installation tool 1000.

Upon actuation of the tool component 1010 of the fastener installation tool 1000, the tool component 1010 supplies rotary drive motion through a gear train 2010 mounted in the gear head 1020 to the socket gear 2020 for rotation of the socket 2030 disposed in the socket gear 2020. The socket 2030 in turn has a non-circular seat for receiving and rotatably driving a threaded nut. The hex key 2050 is attached to the hex key retainer sub-assembly 2040 which is mounted within socket assembly 1060, and the diametric size of the tip end of the hex key 2050 is sufficiently small to fit through a threaded nut, so as to avoid interference with installation of the nut onto the threaded screw fastener. The hex key 2050 is constrained against rotation relative to the fastener by the mating engagement of the hex key 2050 with the hex key retainer 5010 of the socket assembly 1060.

During operation, the installer typically starts rotation of the nut onto the threaded shank of the screw fastener. Upon initial engagement of the nut onto the threaded shank of the screw, the tip end of the hex key 2050 is received into the recess of the screw fastener and the nut is received inside the socket 2030 of the socket assembly 1060.

When initial engagement between the tip end of the hex key 2050 and the recess of the screw fastener occurs, the fastener installation tool 1000 is actuated to drive rotatably the socket 2030 of the socket assembly 1060. This rotatably advances the nut onto the threaded shank of the screw fastener. During this motion, the hex key 2050 retains the shank of the screw fastener against rotation relative to the structures and the socket 2030. Nut advancement is accompanied by the hex key 2050 retracting within the gear head 1020 until the nut reaches the final installed position. Once the nut reaches the final installed position, installation of the fastener is complete.

Figure 3:
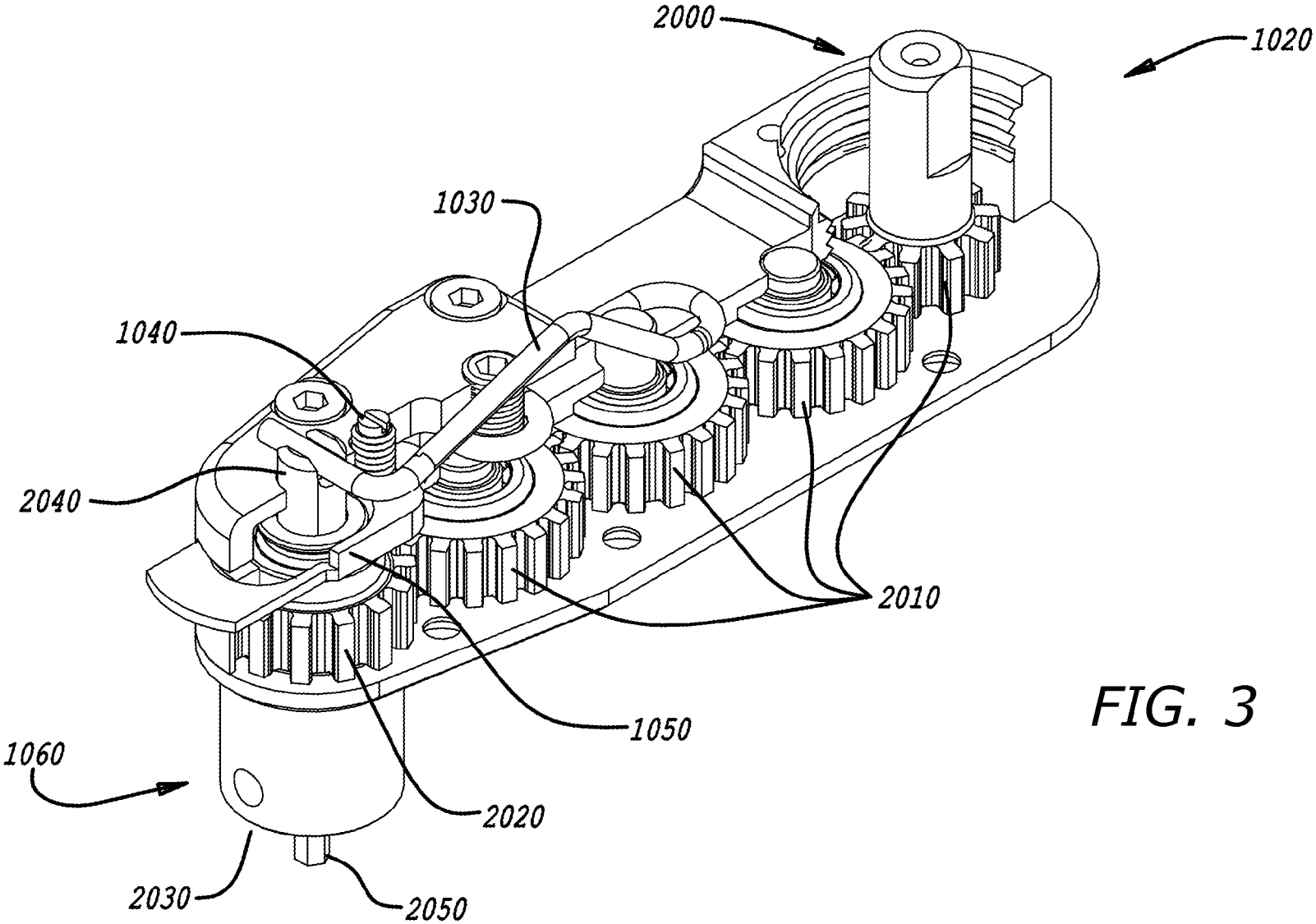
FIG. 3 is a partial cross-sectional view of the gear housing of the gear head of the fastener installation tool with the retaining slide in the unlocked position in accordance with at least one embodiment of the present disclosure.

FIG. 3 contains a partial cross-sectional view of the gear housing 2000 of the gear head 1020 of the fastener installation tool 1000 with the retaining slide 1050 in the unlocked position in accordance with at least one embodiment of the present disclosure. In this figure, a socket assembly 1060 is disengaged with the gear head 1020 of the fastener installation tool 1000. In order for the socket assembly 1060 to be disengaged with the gear head 1020, the lever 1040 must be slid towards the end of the fastener installation tool 1000 that is opposite the end of the tool component 1010.

When the lever 1040 is being moved towards the gear head 1020 end of the fastener installation tool 1000 that is opposite the end of the tool component 1010, the lever 1040 moves the retaining slide 1050 into the unlocked position. When the retaining slide 1050 is being moved into the unlocked position, the retaining slide 1050 disengages the annular groove on the drive shaft of the socket 2030 of the socket assembly 1060. Once the retaining slide 1050 is disengaged with the annular groove, the socket assembly 1060 is no longer secured to the gear head 1020 of the fastener installation tool 1000 and, as such, the socket assembly 1060 is able to drop off the fastener installation tool 1000 as a single fixed structure. When the single fixed structure socket assembly 1060 is completely removed from the fastener installation tool 1000, the installer may attach another single fixed structure socket assembly 1060 having a socket 2030 of a different size to the gear head 1020 of the fastener installation tool 1000.

Figure 4:
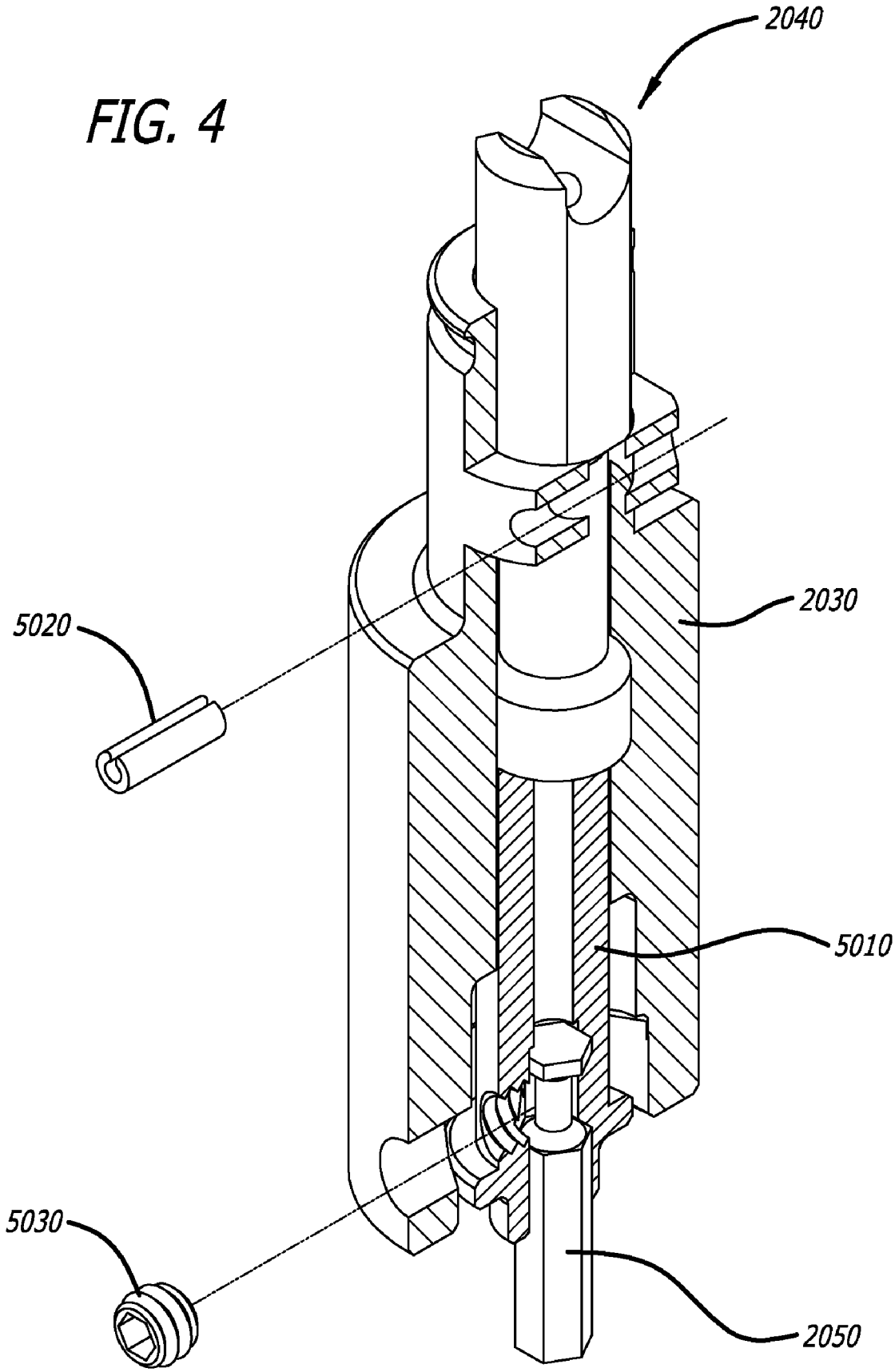
FIG. 4 is a partial cross-sectional view of a portion of the socket assembly in accordance with at least one embodiment of the present disclosure.

FIG. 4 shows a partial cross-sectional view of a portion of the socket assembly 1060 in accordance with at least one embodiment of the present disclosure. This figure depicts the socket assembly 1060 as a single fixed structure. In this figure the portion of the socket assembly 1060 is shown to include a hex key 2050, a hex key retainer 5010, and a socket 2030. The hex key 2050 is mounted coaxially within the internal hex bore of the hex key retainer 5010 by a set screw 5030, thereby creating a hex key retainer sub-assembly 2040. The hex key retainer sub-assembly 2040 is fit coaxially within the bore of the socket 2030 of the socket assembly 1060. The socket 2030 is attached by a roll pin 5020 to the hex key retainer sub-assembly 2040.

Figure 5:
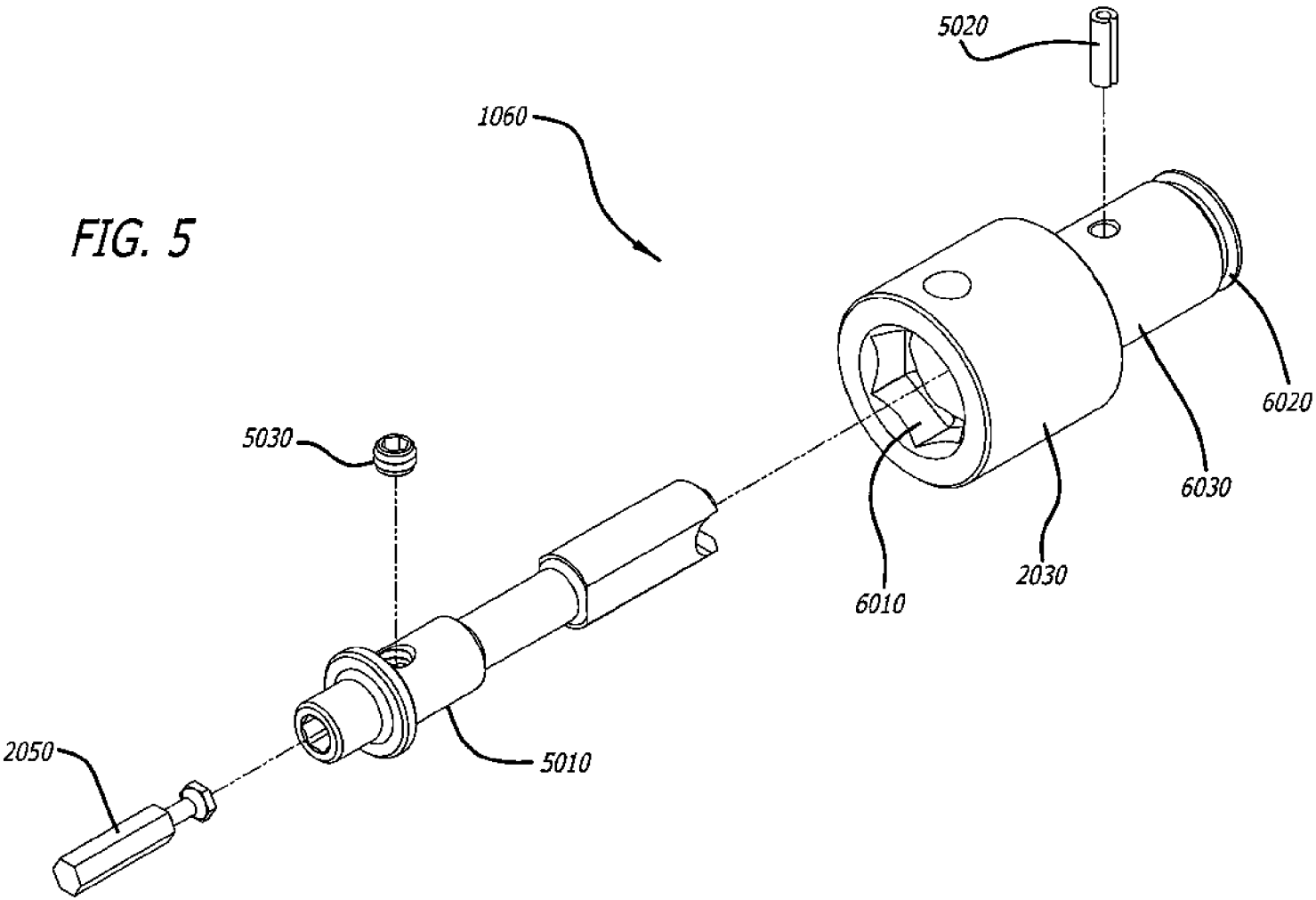
FIG. 5 is an exploded view of the socket assembly in accordance with at least one embodiment of the present disclosure.

FIG. 5 contains an exploded view of the socket assembly 1060 in accordance with at least one embodiment of the present disclosure. In this figure, it is shown that the socket includes a non-circular seat 6010. In addition, the annular groove 6020 around the circumference of the exterior of the drive shaft 6030 of the socket 2030 is depicted. The flat surface 6040 of the non-circular exterior surface of the drive shaft 6030 of the socket 2030 is located on the back side of this view of the socket assembly 1060 and, as such, is not shown in this figure.

Figure 6A:
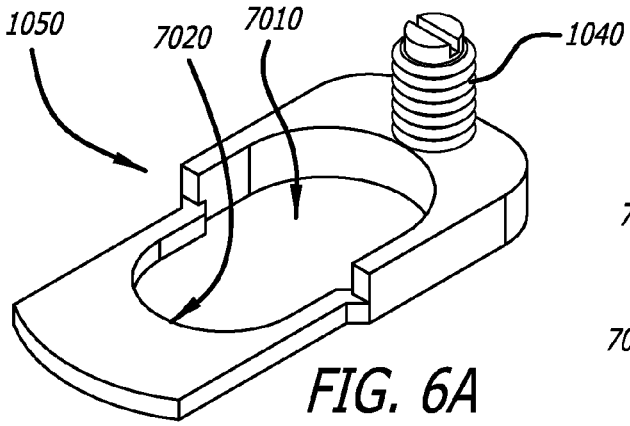
FIG. 6A is one view of the retaining slide and lever in accordance with at least one embodiment of the present disclosure.
Figure 6B:
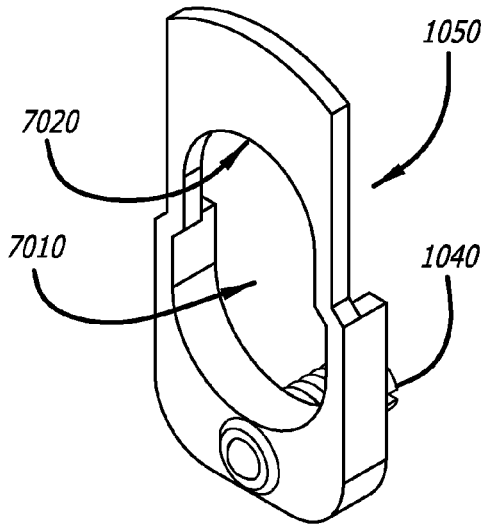
FIG. 6B is another view of the retaining slide and lever in accordance with at least one embodiment of the present disclosure.

FIGS. 6A and 6B show two different views of the retaining slide 1050 and lever 1040 in accordance with at least one embodiment of the present disclosure. In these figures, the lever 1040 is depicted as a ball plunger screw that is attached to the retaining slide 1050. In one or more embodiments, the lever 1040 of the retaining slide 1050 may be employed by various other means. When a socket assembly 1060 is being mounted to a fastener installation tool 1000 and after the drive shaft 6030 of the socket 2030 of the socket assembly 1060 is inserted into the recess of a socket gear 2020 of the gear head 1020 of the fastener installation tool 1000, the drive shaft 6030 of the socket 2030 passes through a large, semi oval-shaped opening 7010 of the retaining slide 1050. When the retaining slide 1050 is slid into the locked position, the inner edge 7020 of the opening 7010 engages the annular groove 6020 of the drive shaft 6030 of the socket 2030 of the socket assembly 1060.

Figure 7A:
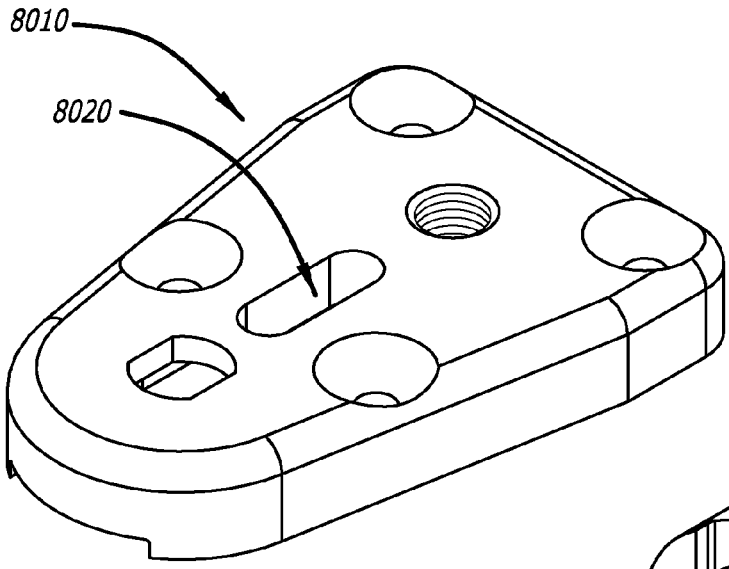
FIG. 7A is one view of the retaining slide housing in accordance with at least one embodiment of the present disclosure.
Figure 7B:
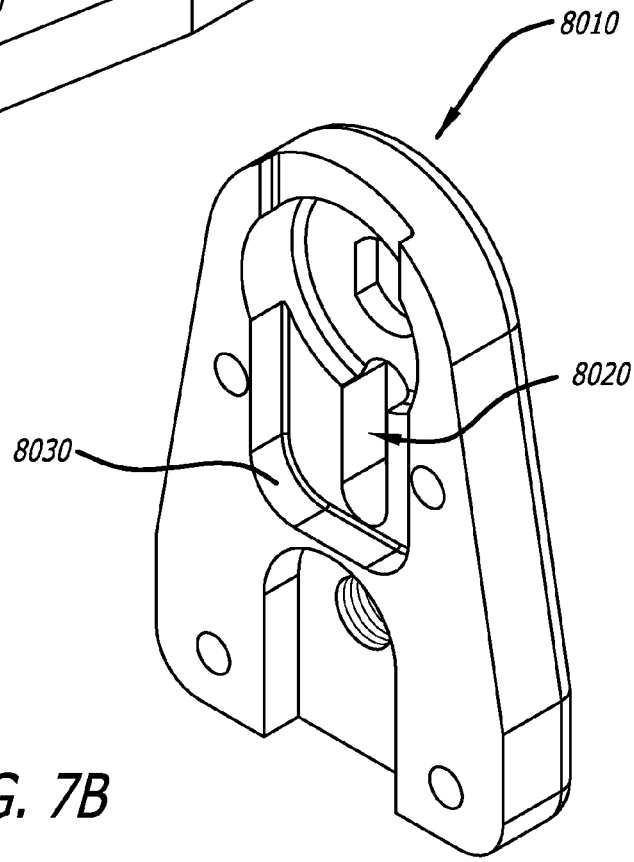
FIG. 7B is another view of the retaining slide housing in accordance with at least one embodiment of the present disclosure.
Figure 8:
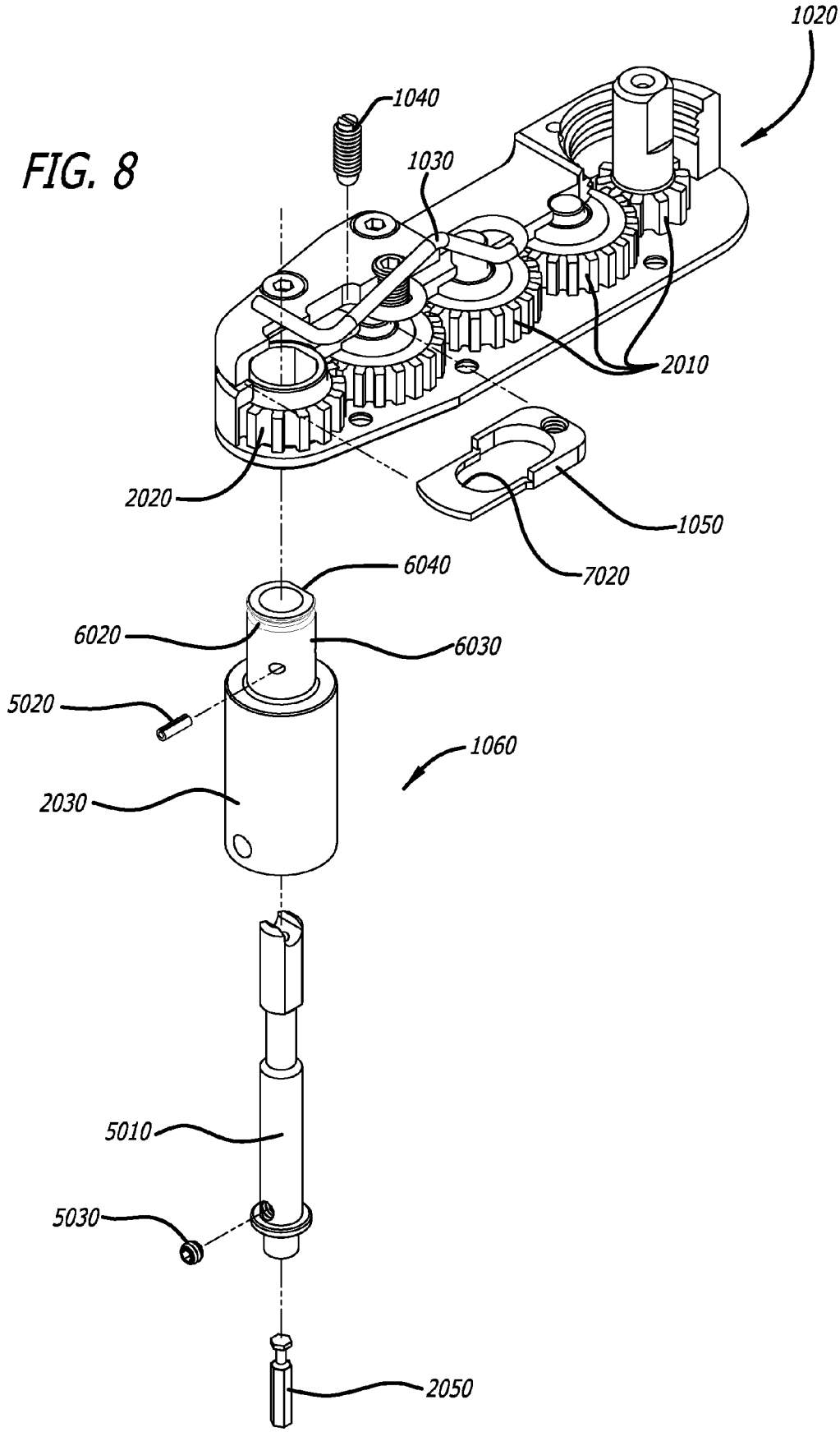
FIG. 8 is a partial cross-sectional view of the gear housing of the gear head of the fastener installation tool and an exploded view of the socket assembly in accordance with at least one embodiment of the present disclosure.

FIGS. 7A and 7B contain two views of the retaining slide housing 8010 in accordance with at least one embodiment of the present disclosure. The retaining slide 1050 fits inside a large, semi oval-shaped opening 8030 of the retaining slide housing 8010. The large, semi oval-shaped opening 8030 of the retaining slide housing 8010 is larger than the outer edge of the retaining slide 1050 such that the retaining slide 1050 is able to slide back and forth within the retaining slide housing 8010 when the lever 1040 is slid back and forth from the locked position to the unlocked position. The lever 1040 fits within an elongated double D shaped opening 8020 of the retaining slide housing 8010. The retaining slide housing 8010 is attached to the gear housing 2000 of the gear head 1020 of the fastener installation tool 1000. FIG. 8 depicts a partial cross-sectional view of the gear housing of the gear head of the fastener installation tool as well as an exploded view of the socket assembly in accordance with at least one embodiment of the present disclosure.

Although certain illustrative embodiments and methods have been disclosed herein, it can be apparent from the foregoing disclosure to those skilled in the art that variations and modifications of such embodiments and methods can be made without departing from the true spirit and scope of the art disclosed. Many other examples of the art disclosed exist, each differing from others in matters of detail only. Accordingly, it is intended that the art disclosed shall be limited only to the extent required by the appended claims and the rules and principles of applicable law.

We claim:

1. A fastener installation tool comprising:

a tool component; and a gear head having a first end and a second end opposite the first end, wherein the first end of the gear head is attached to an end of the tool component, wherein the gear head further comprises a lever, a retaining slide having a free end, a retaining slide housing, and at least one gear, wherein the at least one gear comprises a socket gear, wherein the lever is attached to the retaining slide, wherein the retaining slide is housed inside the retaining slide housing and the lever protrudes out from an exterior surface of the retaining slide housing, wherein the retaining slide is movable between a locked position, in which the free end of the retaining slide is housed within the retaining slide housing, and an unlocked position, in which the free end of the retaining slide protrudes outwardly from the exterior surface of the retaining slide housing at the second end of the gear head, the free end of retaining slide providing a visual indication that the retaining slide is in its locked position or unlocked position, wherein, when the retaining slide is in its locked position, a drive shaft of a socket attaches to the gear head of the fastener installation tool, wherein the socket gear matingly engages the drive shaft of the socket to rotate the socket.

2. The fastener installation tool of claim 1, wherein the lever is a ball plunger screw.

3. The fastener installation tool of claim 1, wherein the fastener installation tool is powered by pneumatic energy.

4. The fastener installation tool of claim 1, wherein the socket gear has a non-circular interior surface, wherein the drive shaft of the socket has a non-circular exterior surface that is complementary in shape to the non-circular interior surface of the socket gear, wherein the non-circular exterior surface of the drive shaft of the socket matingly engages inside the non-circular interior surface of the socket gear.

5. The fastener installation tool of claim 4, wherein the non-circular interior surface of the socket gear includes a flat surface, and wherein the non-circular exterior surface of the drive shaft of the socket includes a flat surface.

6. The fastener installation tool of claim 1, wherein the retaining slide housing includes an opening that is sized and shaped to enable the free end of the retaining slide to protrude outwardly from the retaining slide housing when the retaining slide is in its unlocked position.

7. The fastener installation tool of claim 1, wherein the fastener installation tool is powered by DC/AC electricity.

8. The fastener installation tool of claim 1, wherein the fastener installation tool is powered by at least one battery.

9. A system for installing fasteners comprising:

a fastener installation tool, wherein the fastener installation tool comprises a tool component and a gear head having a first end and a second end opposite the first end, wherein the first end of the gear head is attached to an end of the tool component, wherein the gear head further comprises a lever, a retaining slide having a free end, a retaining slide housing, and at least one gear, wherein the at least one gear comprises a socket gear, wherein the lever is attached to the retaining slide, wherein the retaining slide is housed inside the retaining slide housing and the lever protrudes out from an exterior surface of the retaining slide housing; and a socket assembly, wherein the socket assembly comprises a socket, wherein an end of a drive shaft of the socket has an annular groove around a circumference of a exterior surface of the drive shaft, wherein the retaining slide is movable between a locked position, in which the free end of the retaining slide is housed within the retaining slide housing, and an unlocked position, in which the free end of the retaining slide protrudes outwardly from the exterior surface of the retaining slide housing at the second end of the gear head, the free end of retaining slide providing a visual indication that the retaining slide is in its locked position or unlocked position, wherein when the retaining slide is in its locked position, the retaining slide engages the annular groove of the drive shaft of the socket, thereby attaching the drive shaft of the socket to the gear head of the fastener installation tool, wherein the socket gear matingly engages the drive shaft of the socket to rotate the socket.

10. The system for installing fasteners of claim 9, wherein the lever is a ball plunger screw.

11. The system for installing fasteners of claim 9, wherein the fastener tool is powered by pneumatic energy.

12. The system for installing fasteners of claim 9, wherein the fastener tool is powered by DC/AC electricity.

13. The system for installing fasteners of claim 9, wherein the fastener tool is powered by at least one battery.

14. The system for installing fasteners of claim 9, wherein the fastener tool is powered by hydraulic energy.

15. The system for installing fasteners of claim 9, wherein the socket gear has a non-circular interior surface, wherein the drive shaft of the socket has a non-circular exterior surface that is complementary in shape to the non-circular interior surface of the socket gear, wherein the non-circular exterior surface of the drive shaft of the socket matingly engages inside the non-circular interior surface of the socket gear.

16. The system for installing fasteners of claim 15, wherein the non-circular interior surface of the socket gear includes a flat surface, and wherein the non-circular exterior surface of the drive shaft of the socket includes a flat surface.

17. The system for installing fasteners of claim 9, wherein the retaining slide housing includes an opening that is sized and shaped to enable the free end of the retaining slide to protrude outwardly from the retaining slide housing when the retaining slide is in its unlocked position.

* * * * *